US008109505B2

(12) United States Patent
Shih et al.

(10) Patent No.: US 8,109,505 B2
(45) Date of Patent: Feb. 7, 2012

(54) PRINTER WITH PAPER HOLDING DEVICE

(75) Inventors: Chih-Kun Shih, Santa Clara, CA (US); Chun-Hsien Lin, Taipei-Hsien (TW); Chen-Lu Fan, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/780,848

(22) Filed: May 14, 2010

(65) Prior Publication Data

US 2011/0148030 A1 Jun. 23, 2011

(30) Foreign Application Priority Data

Dec. 17, 2009 (CN) ..... 2009 1 0311696

(51) Int. Cl.
*B65H 31/20* (2006.01)

(52) U.S. Cl. ..... 271/223; 271/221; 271/222; 271/224

(58) Field of Classification Search ..... 271/221–224, 271/171
See application file for complete search history.

(56) References Cited

U.S. PATENT DOCUMENTS 4,597,572 A * 7/1986 Nukaya ..... 271/171
4,607,834 A * 8/1986 Dastin ..... 271/171
4,826,421 A * 5/1989 Asano et al. ..... 425/403.1
5,172,903 A * 12/1992 Haneda et al. ..... 271/171
5,251,889 A * 10/1993 Spencer et al. ..... 271/171
5,634,634 A * 6/1997 Dobbertin et al. ..... 271/3.02
5,743,518 A * 4/1998 Takashimizu et al. ..... 271/4.1
5,961,114 A * 10/1999 Barker et al. ..... 271/184
6,073,925 A * 6/2000 Sato ..... 271/171
6,102,385 A * 8/2000 Wakamatsu et al. ..... 270/58.12
6,168,154 B1 * 1/2001 Asahara et al. ..... 271/245
6,305,281 B1 * 10/2001 Aizawa ..... 101/118
7,464,930 B2 * 12/2008 Masuda et al. ..... 271/224
7,648,137 B2 * 1/2010 Ogashiwa ..... 271/207

* cited by examiner

*Primary Examiner* — Kaitlin Joerger
*Assistant Examiner* — Prasad Gokhale
(74) *Attorney, Agent, or Firm* — Altis Law Group, Inc.

(57) ABSTRACT

A printer includes a main body and a paper holding device. The main body is capable of printing and outputting paper. The paper holding device is secured to the main body, and includes a paper tray, a plurality of sliding members, a connecting mechanism, and a driving mechanism. The paper tray is configured for receiving the outputted paper. The sliding members are slidably located on the paper tray. The connecting mechanism is attached to the paper tray and connected to the sliding members. The driving mechanism is attached to the paper tray and capable of driving the connecting mechanism to slide the plurality of sliding members to shape a space to fit the size of outputted paper.

19 Claims, 10 Drawing Sheets

PRINTER WITH PAPER HOLDING DEVICE

BACKGROUND

1. Technical Field

The present disclosure relates to a printer with a paper holding device for receiving outputted paper.

2. Description of Related Art

Many printers include a paper tray. However, when the printed sheet is deposited into the paper tray after printing, the sheets of paper may not be neatly stacked on top of each other because the sides of the sheets are misaligned. The stack of sheets must be taken out of the paper tray and aligned manually by a user. This is an inconvenience.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
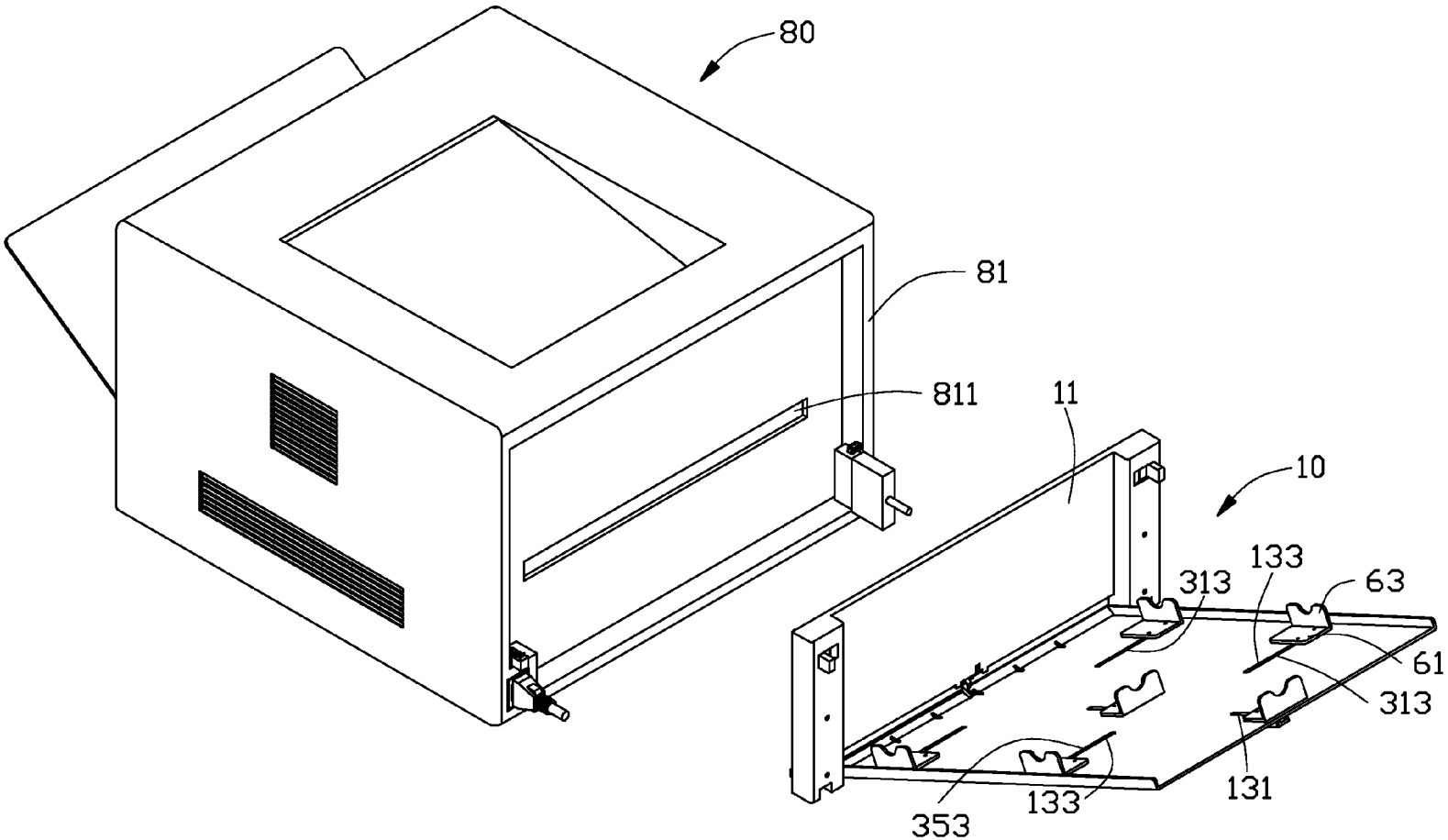
FIG. 1 is a partially exploded view of a printer in accordance with an embodiment.

Referring to FIG. 1, a printer in accordance with an embodiment includes a main body 80 and a paper holding device 10.

The main body 80 is capable of printing documents on paper and outputting the paper through an opening 811 defined in a rear wall 81 thereof.

Figure 2:
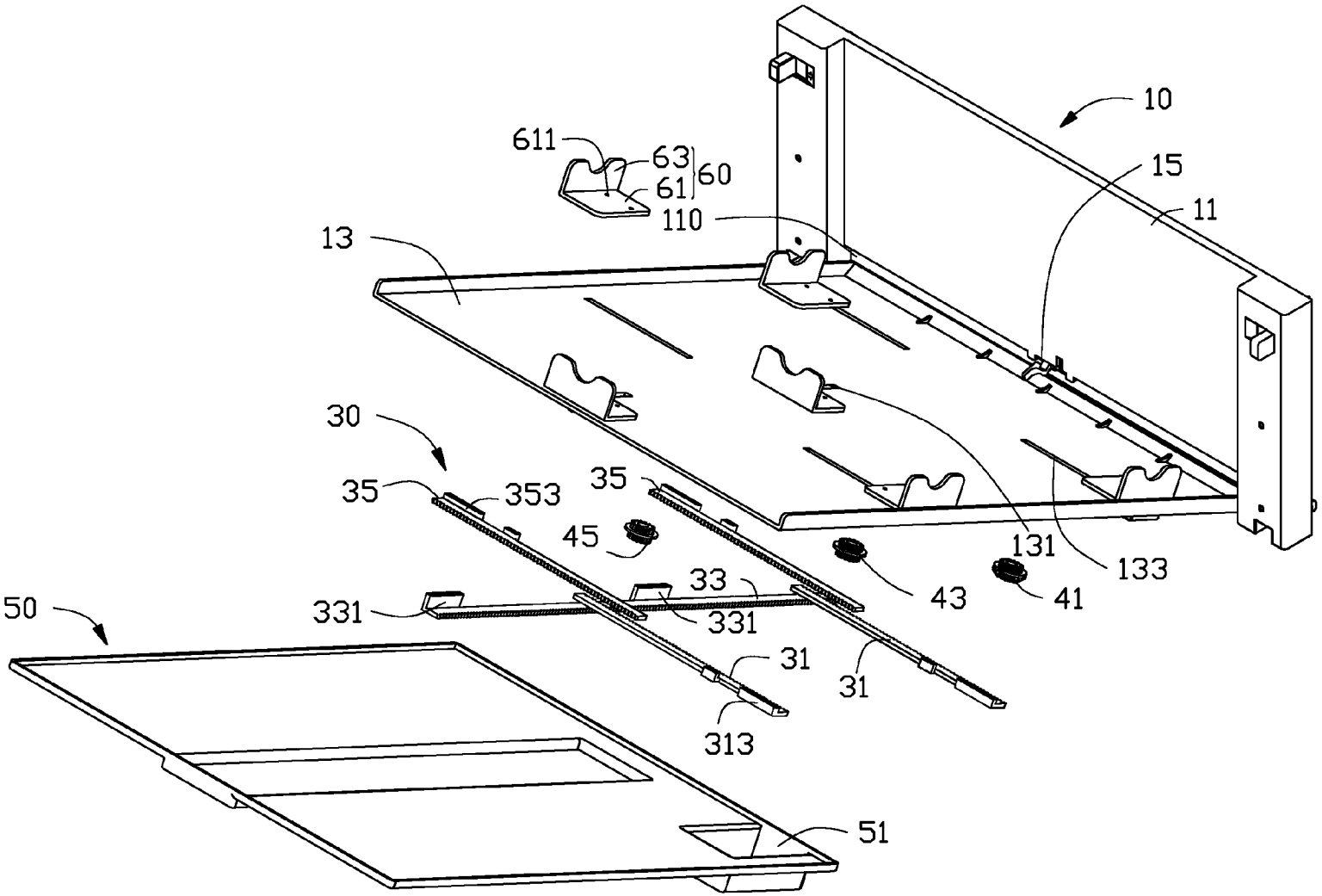
FIG. 2 is a partially exploded view of a paper holding device of FIG. 1.

Referring to FIG. 2, the paper holding device 10 includes a securing member 11, a paper tray 13, a connecting mechanism 30, and a cover 50.

Figure 4:
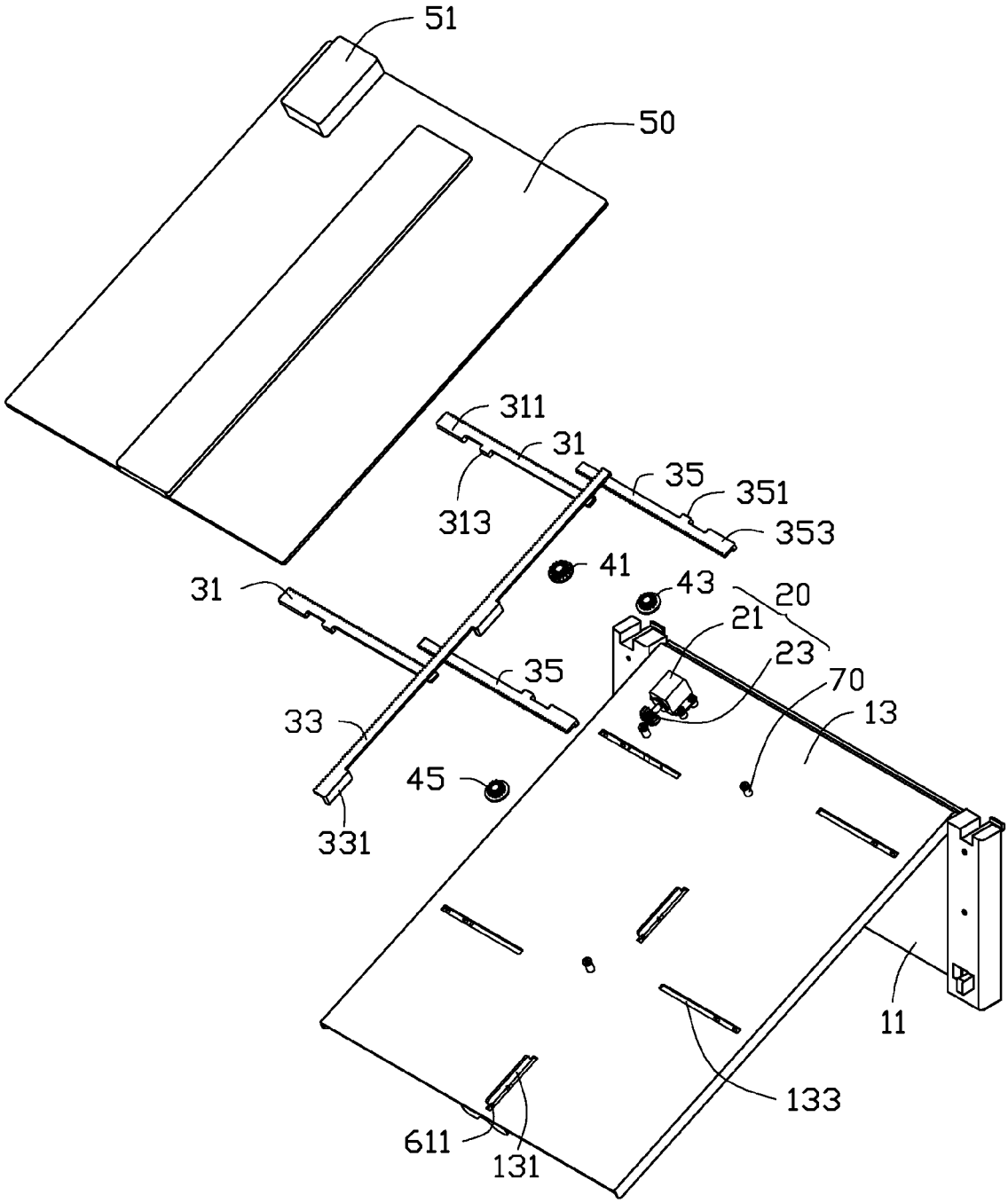
FIG. 4 is similar to FIG. 2, but viewed from another aspect.

The securing member 11 is capable of being secured to the main body 80. The paper tray 13 is pivotably secured to a bottom portion of the securing member 11. A gap 110 is defined between the securing member 11 and the paper tray 13, for the outputted paper to pass therethrough. A sensor 15 is disposed on the paper tray 13 adjacent to the gap 110 for detecting the outputted paper as it passes through the gap 110. Two first slots 131 and four second slots 133 are defined in the paper tray 13. In an embodiment, the first slots 131 are substantially perpendicular to the second slots 133. A plurality of sliding members 60 is slidably attached to a top surface of the paper tray 13. Each sliding member 60 includes a sliding portion 61 and a pushing portion 63 located on the sliding portion 61. In an embodiment, the pushing portion 63 is substantially perpendicular to the sliding portion 61. Two fastener holes 611 are defined in the sliding portion 61. Referring to FIG. 4, three positioning posts 70 are located on the paper tray 13. A driving mechanism 20 is secured to the paper tray 13 adjacent one positioning post 70.

The driving mechanism 20 is secured to a bottom surface of the paper tray 13 and includes a motor 21 and a driving gear 23. The motor 21 is capable of being controlled by the sensor 15 (FIG. 1) to rotate the driving gear 23.

Figure 3:
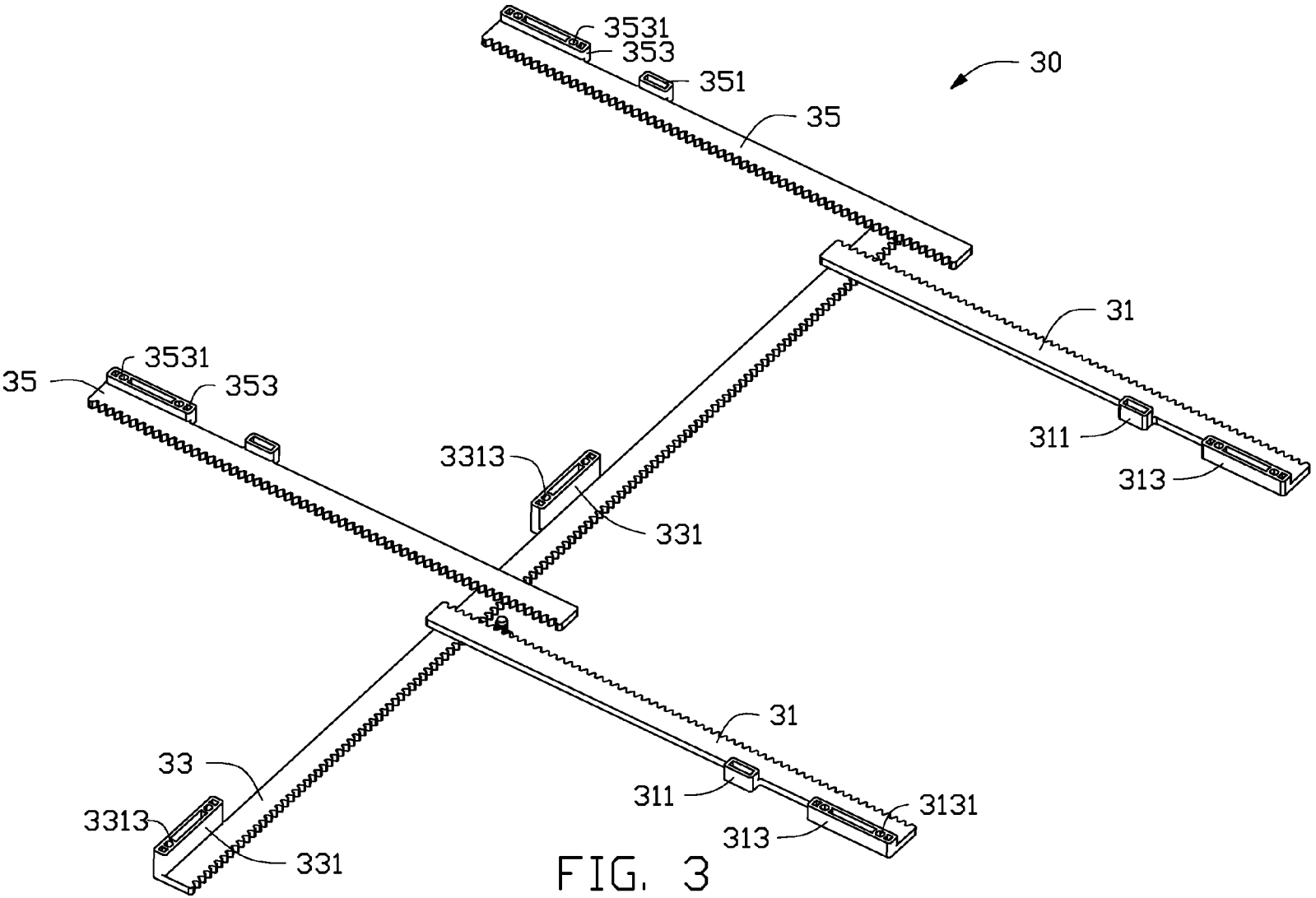
FIG. 3 is an isometric view of a connecting mechanism of FIG. 1.

Referring to FIG. 3, the connecting mechanism 30 is attachable to the bottom surface of the paper tray 13 and includes two first gear members 31, a third gear member 33, and two second gear members 35. In an embodiment, the first gear members 31 are substantially perpendicular to the third gear member 33 and parallel to the second gear members 35. Each of the first gear members 31 includes a first limiting block 311 and a first sliding block 313 both capable of sliding in two second slots 133. Two first mounting holes 3131 are defined in each first sliding block 313, corresponding to the fastener holes 611 of the corresponding sliding member 60. Each second gear member 35 includes a second limiting block 351 and a second sliding block 353 both capable of sliding in two second slots 133. Two second mounting holes 3531 are defined in each second sliding block 353, corresponding to the fastener holes 611 of the corresponding sliding member 60. The third gear member 33 includes two third sliding blocks 331 capable of sliding in the first slots 131. Each third sliding block 331 defines two third mounting holes 3313, corresponding to the fastener holes 611 of the corresponding sliding member 60. A first connecting gear 41, a second connecting gear 43, and a third connecting gear 45 are respectively secured to the positioning posts 70. The first connecting gear 41 is capable of meshing with the driving gear 23 and one first gear member 35. The second connecting gear 43 is capable of meshing with one of the two first gear members 31, one of the two second gear members 35, and the third gear member 33. The third gear 43 is capable of meshing with the other gear member 31, the other second gear member 35, and the third gear member 33.

Referring to FIGS. 2 and 4, the cover 50 is securable to the bottom surface of the paper tray 13 to cover the connecting mechanism 30 and the driving mechanism 20. A recess 51 is defined in the cover 50 for receiving the driving mechanism 20.

Figure 5:
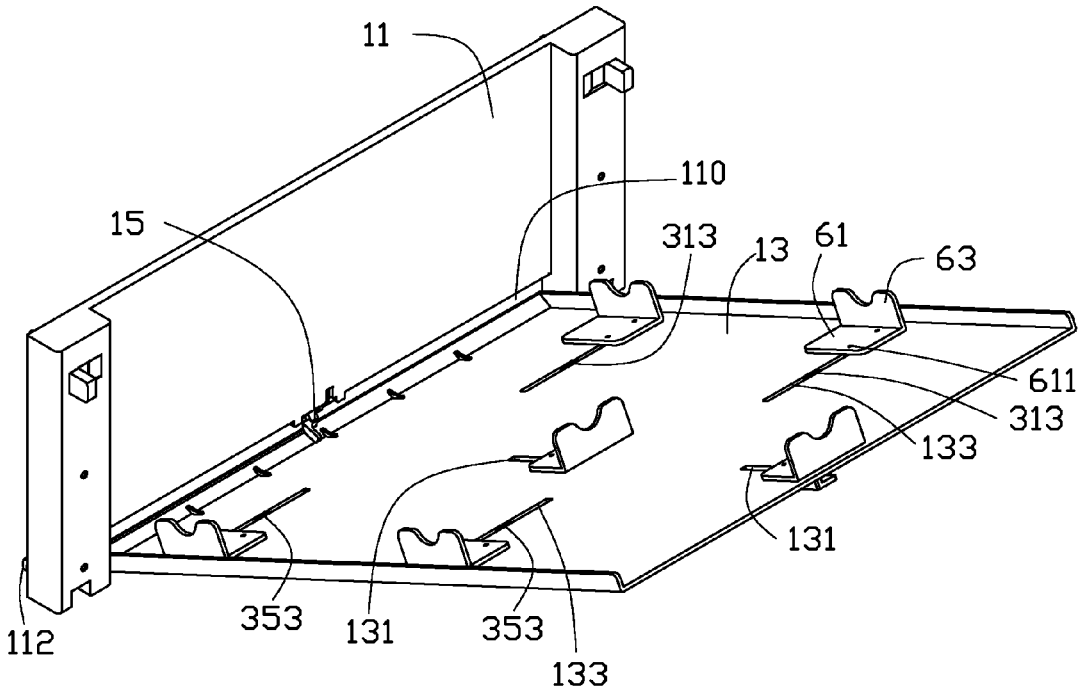
FIG. 5 is an assembled view of the paper holding device of FIG. 2.
Figure 6:
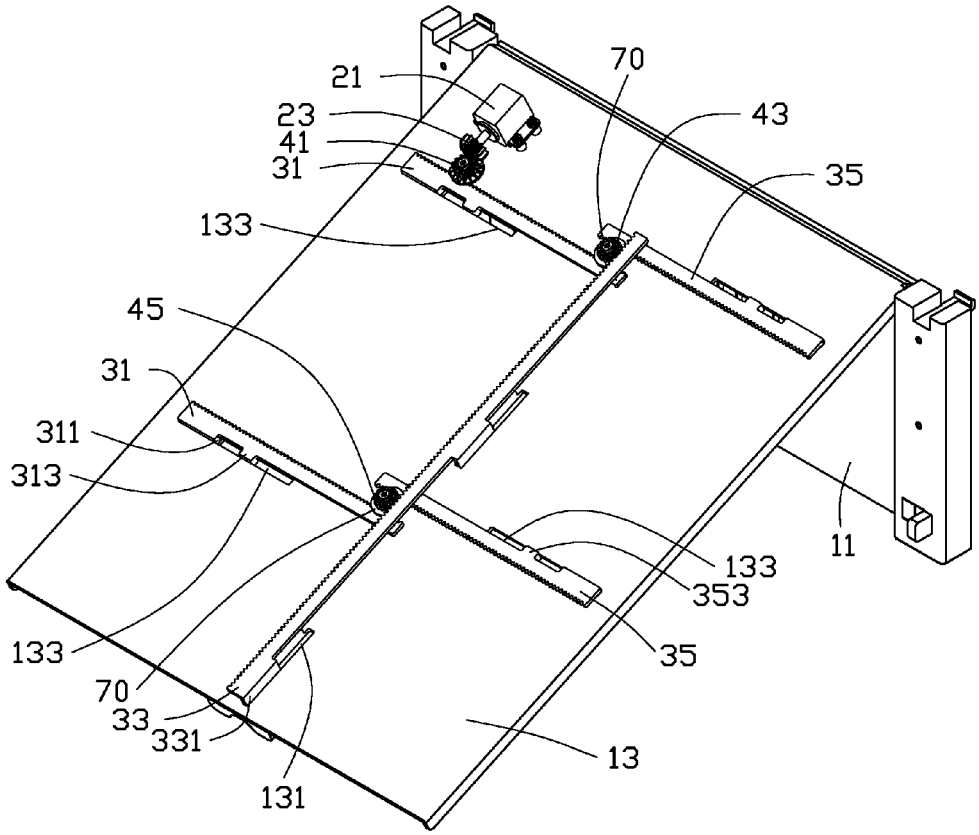
FIG. 6 is similar to FIG. 5, but viewed from another aspect.
Figure 7:
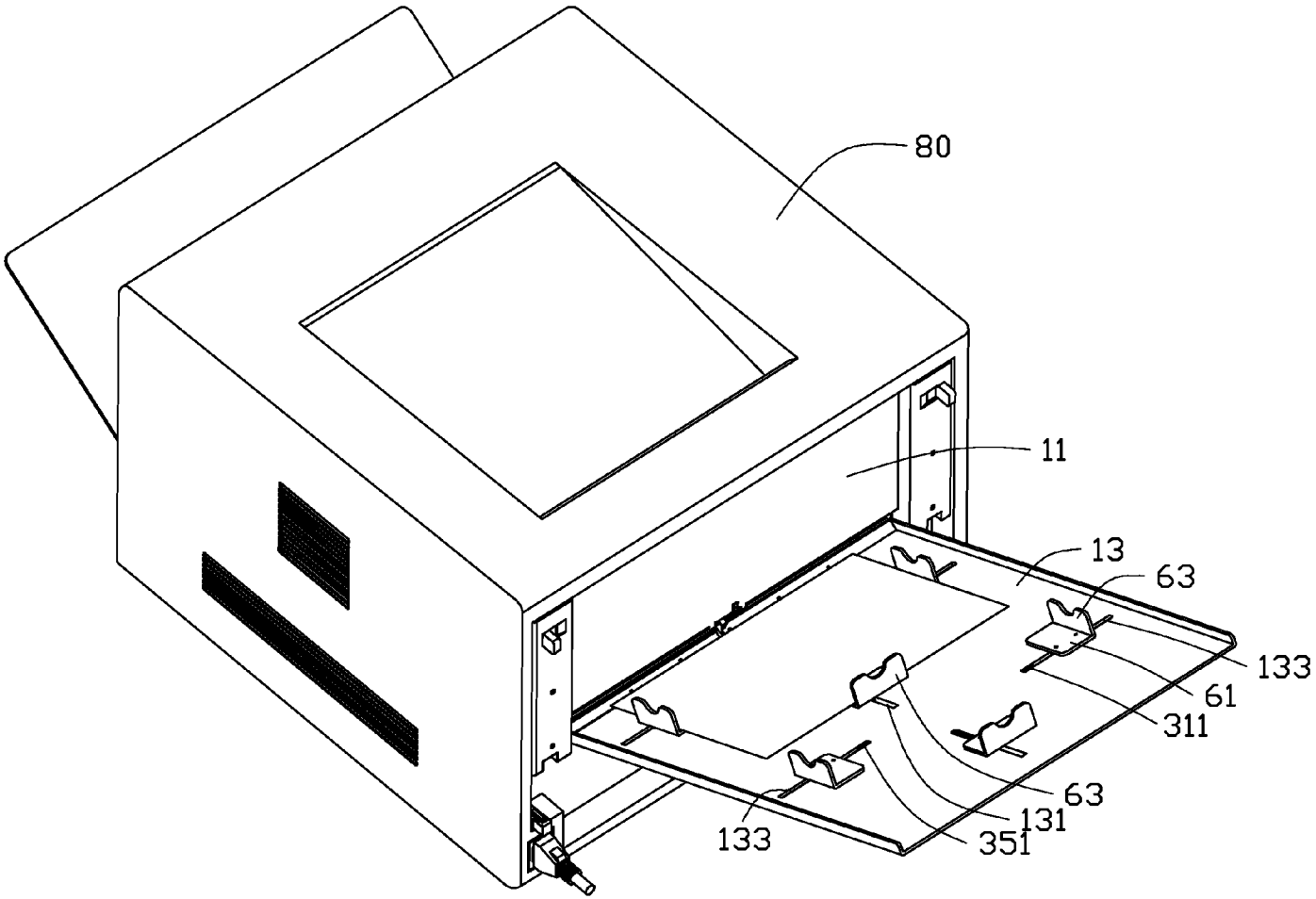
FIG. 7 is an assembled view of the printer of FIG. 1.

Referring to FIGS. 5 and 6, in assembly, the sliding members 60 are placed on the top surface of the paper tray 13. The first and second sliding blocks 313, 353 and the first and second limiting blocks 311, 351 are slidably engaged in the first slots 133. The third sliding blocks 331 are slidably engaged in the second slots 131. Fasteners, such as screws are extended through the first, second and third mounting holes 3131, 3151, 3313 into the corresponding fastener holes 611 of the sliding members 60 to correspondingly secure the sliding members 60 on the first, second and third sliding blocks 313, 353, 331. The first connecting gear 41, the second connecting gear 43, and the third connecting gear 45 are secured to the positioning posts 70 and mesh with the driving gear 23, and the first, second, and third gear members 31, 35, 33 as detailed above. The cover 50 is secured to the bottom surface of the paper tray 13 to cover the connecting mechanism 30 and the driving mechanism 20, and the driving mechanism 20 is received in the recess 51. Referring to FIGS. 1, 2 and 7, the paper holding device 10 is secured to the rear wall 811 of the main body 80, and the output opening 811 corresponding to the gap 110.

Figure 8:
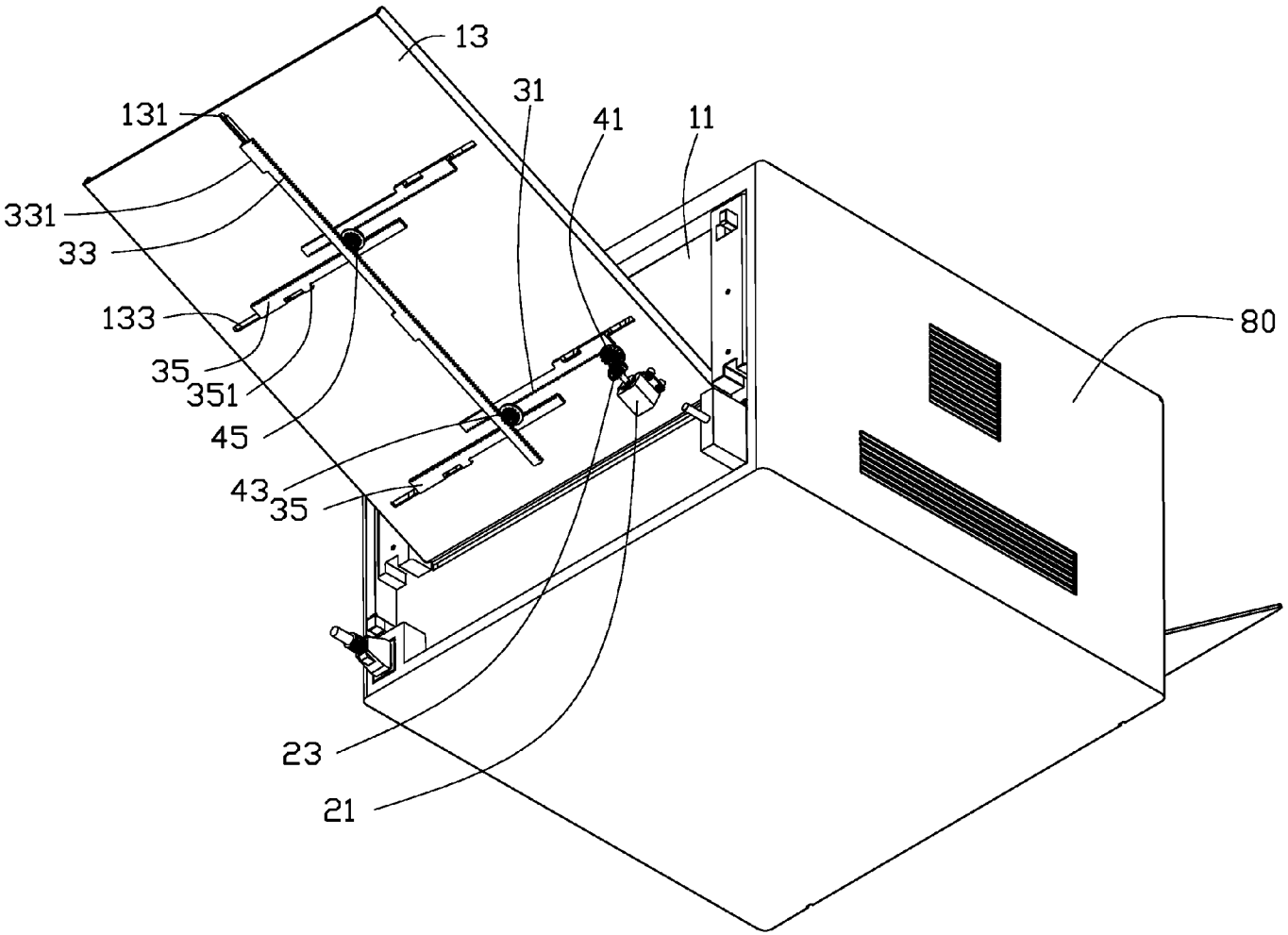
FIG. 8 is similar to FIG. 7, but viewed from another aspect.

Referring to FIGS. 7 and 8, when documents are printed by the main body 80 and outputted paper is output from the output opening 811, the sensor 15 detects the size of the outputted paper and controls the motor 21 of the driving mechanism 20 to rotate the driving gear 23. Rotation of the driving gear 23 can slide the first gear member 31, which meshes with the driving gear 23. Connections of the first to third gear members 31, 35, 33 and the first to third gears 41, 43, 45, cause the first gear members 31 to slide in a first direction, the second gear members 35 to slide in a second direction opposite to the first direction, and the third gear member 33 to slide in a third direction substantially perpendicular to the first direction. Three sliding members 60, adjacent to the main body 80, reshape a first space for receiving the outputted paper and causing the paper to precisely stack in a neat orderly stack.

Figure 9:
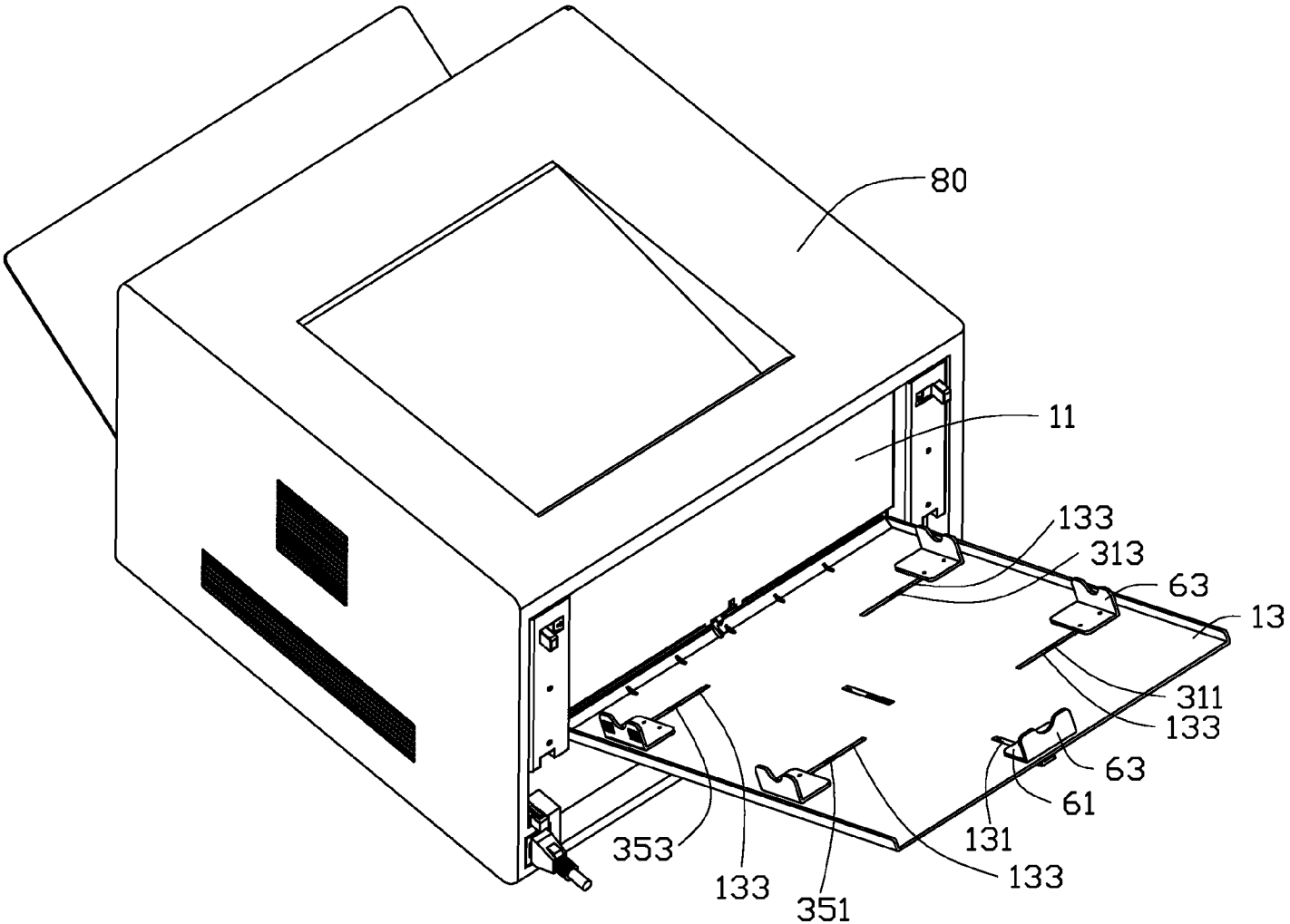
FIG. 9 is similar to FIG. 7, but showing sliding members in a different location.
Figure 10:
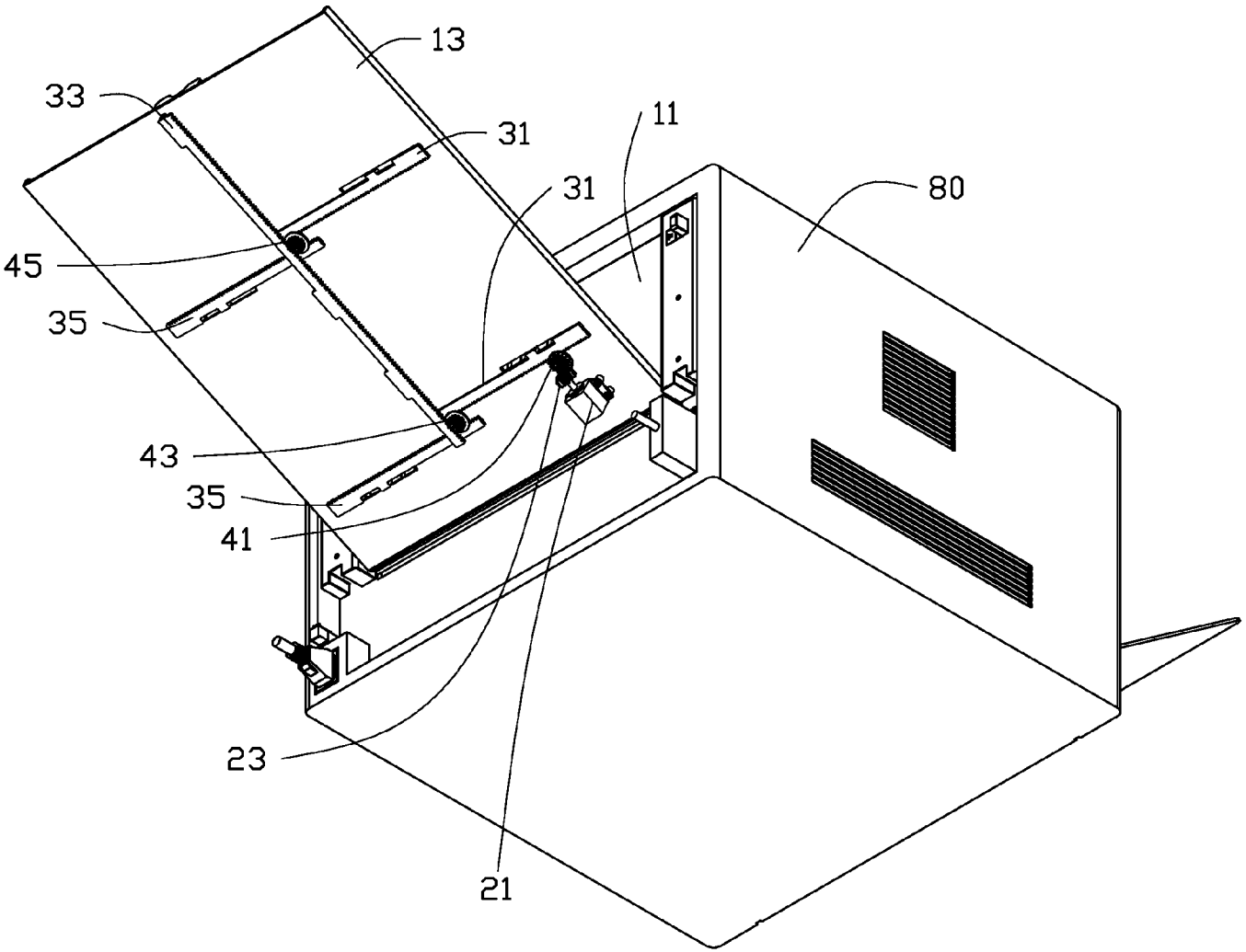
FIG. 10 is similar to FIG. 9, but viewed from another aspect.

Referring to FIGS. 9 and 10, if another larger size paper is printed, one sliding member 60, which is normally positioned in a center of the paper tray 13, is removed from the paper tray 13. When the larger size outputted paper output from the output opening 811, the sensor 15 detects the size of the outputted paper and controls the motor 21 of the driving mechanism 20 to rotate the driving gear 23. The sliding members 60 are adjusted by the connecting mechanism 30 and the driving mechanism 20 to reshape to a second space for receiving the larger size outputted paper.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A printer comprising:

a main body capable of printing and outputting paper; and a paper holding device secured to the main body, the paper holding device comprising:

a paper tray configured for receiving the outputted paper;

a plurality of sliding members slidably located on the paper tray;

a connecting mechanism attached to the paper tray and comprising a plurality of first gear members, a plurality of second gear members, and a third gear member connected to the sliding members; a first connecting gear meshed with one of the plurality of first gear members, a second connecting gear meshed with the one of the plurality of first gear members, one of the plurality of second gear members and the third gear member; and a third connecting gear meshed with another first gear member, another second gear member and the third gear member; and a driving mechanism attached to the paper tray and capable of driving the first connecting gear to slide the one of the plurality of first gear members; the one of the plurality of first gear members capable of driving the second connecting gear to slide the one of the plurality of second gear members and the third gear member; and the third gear member capable of driving the third connecting gear to slide the another first gear member and the another second gear member.

2. The printer of claim 1, wherein the paper holding device further comprises a sensor controlling the driving mechanism to drive the connecting mechanism by detecting the outputted paper.

3. The printer of claim 2, wherein the paper tray defines a plurality of first slots and a plurality of second slots; and the plurality of sliding members are connected to the connecting mechanism via the plurality of first slots and second slots.

4. The printer of claim 1, wherein the driving mechanism comprises a motor and a driving gear; the motor is capable of being controlled to rotate the driving gear; and the driver gear meshes with the one first gear member.

5. The printer of claim 3, wherein a sliding block is located on each of the first, second and third gear members; the sliding blocks are slidable in the first and second slots and secured to the sliding members.

6. The printer of claim 1, wherein the main body comprises a rear wall; the rear wall defines an output opening for outputting the outputted paper; the paper holding device further comprises a securing member secured to the rear wall and defines a gap between the securing member and the paper tray; and the gap corresponds to the output opening.

7. The printer of claim 1, wherein the sliding members are located on a top surface of the paper tray; and the connecting mechanism and the driving mechanism are attached to a bottom surface of the paper tray.

8. The printer of claim 7, wherein the paper holding device further comprises a cover attached to the bottom surface of the paper tray to cover the connecting mechanism and the driving mechanism.

9. The printer of claim 8, wherein the cover defines a recess for receiving the driving mechanism.

10. A printer comprising:

a main body capable of printing and outputting paper; and a paper holding device secured to the main body, the paper holding device comprising:

a paper tray configured for receiving the outputted paper;

a plurality of sliding members slidably located on the paper tray and shaping a first space for receiving the outputted paper having first sizes;

a connecting mechanism attached to the paper tray and comprising a plurality of first gear members, a plurality of second gear members, and a third gear member connected to the sliding members; a first connecting gear meshed with one of the plurality of first gear members, a second connecting gear meshed with the one of the plurality of first gear members, one of the plurality of second gear members and the third gear member; and a third connecting gear meshed with another first gear member, another second gear member and the third gear member;

a driving mechanism attached to the paper tray and capable of driving the first connecting gear to slide the one of the plurality of first gear members; the one of the plurality of first gear members capable of driving the second connecting gear to slide the one of the plurality of second gear members and the third gear member; and the third gear member capable of driving the third connecting gear to slide the another first gear member and the another second gear member; and a sensor capable of controlling the driving mechanism to drive the connecting mechanism to slide the plurality of sliding members to reshape the first space to a second space for fitting another outputted paper having second sizes, which are different from the first sizes.

11. The printer of claim 10, wherein the paper tray defines a plurality of first slots and a plurality of second slots; and the plurality of sliding members are connected to the connecting mechanism via the plurality of first slots and second slots.

12. The printer of claim 10, wherein the driving mechanism comprises a motor and a driving gear; the motor is capable of being controlled to rotate the driving gear; and the driving gear meshes with one first gear member.

13. The printer of claim 11, wherein a sliding block is located on each of the first, second and third gear members; the sliding blocks are slidable in the first and second slots and secured to the sliding members.

14. The printer of claim 10, wherein the main body comprises a rear wall; the rear wall defines an output opening for outputting the outputted paper; the paper holding device further comprises a securing member secured to the rear wall and defines a gap between the securing member and the paper tray; and the gap corresponds to the output opening.

15. The printer of claim 10, wherein the sliding members are located on a top surface of the paper tray; and the connecting mechanism and the driving mechanism are attached to a bottom surface of the paper tray.

16. The printer of claim 15, wherein the paper holding device further comprises a cover attached to the bottom surface of the paper tray to cover the connecting mechanism and the driving mechanism.

17. The printer of claim 16, wherein the cover defines a recess for receiving the driving mechanism.

18. The printer of claim 1, wherein two of the plurality of sliding members are located on each of a first side of the paper tray and a second side of the paper tray opposite to the first side, one of the plurality of sliding members is located on a third side of the paper tray adjacent to the first side, and one of the plurality of the sliding member is normally located on a center of the paper tray; a first space is shaped by one sliding member located on the first side, one sliding member located on the second side and the one sliding member normally located on the center of the paper tray; a second space larger than the first space is shaped by the two sliding members located on the first side, the two sliding members located on the second side and the one sliding member located on the third side, and the one sliding member normally located on the center of the paper tray is removed from the paper tray.

19. The printer of claim 10, wherein two of the plurality of sliding members are located on each of a first side of the paper tray and a second side of the paper tray opposite to the first side, one of the plurality of sliding members is located on a third side of the paper tray adjacent to the first side, and one of the plurality of the sliding member is normally located on a center of the paper tray; the first space is shaped by one sliding member located on the first side, one sliding member located on the second side and the one sliding member normally located on the center of the paper tray; the second space is shaped by the two sliding members located on the first side, the two sliding members located on the second side and the one sliding member located on the third side, and the one sliding member normally located on the center of the paper tray is removed from the paper tray.

* * * * *